United States Patent [19]

Takemae et al.

[11] Patent Number: 4,663,927

[45] Date of Patent: May 12, 1987

[54] METHOD AND APPARATUS FOR PRODUCING SLUB YARN

[75] Inventors: Shigeru Takemae; Yasuo Takada; Shuichiro Tokuda; Noriyuki Furukawa; Hitoshi Kodama, all of Nagoya, Japan

[73] Assignee: Mitsubishi Rayon Company, Ltd., Tokyo, Japan

[21] Appl. No.: 781,892

[22] Filed: Sep. 30, 1985

[30] Foreign Application Priority Data

Oct. 1, 1984 [JP] Japan ..... 59-205896
Jun. 19, 1985 [JP] Japan ..... 60-133398

[51] Int. Cl.[4] ..... D02G 3/34; D02G 1/02

[52] U.S. Cl. ..... 57/6; 57/91; 57/207; 57/208; 57/284

[58] Field of Search ..... 57/6, 90, 91, 12, 206–209, 57/284–291

[56] References Cited

U.S. PATENT DOCUMENTS 3,945,189 3/1976 Allen ..... 57/207 X
3,952,496 4/1976 Nagel et al. ..... 57/207
4,010,601 3/1977 Anahara et al. ..... 57/207 X
4,124,973 11/1978 Hense et al. ..... 57/207
4,566,259 1/1986 Durand ..... 57/207 X

FOREIGN PATENT DOCUMENTS 55-22576 6/1980 Japan .
58-109645 6/1983 Japan .

*Primary Examiner*—John Petrakes
*Attorney, Agent, or Firm*—Oblon, Fisher, Spivak, McClelland & Maier

[57] ABSTRACT

A slub yarn, in which a sheath component is wound around a core component to form a plurality of slub portions along the axis of the yarn, which structure is obtained by simultaneously false-twist texturing the core and sheath components. The slub yarn has a feature that the slub portion includes a multilayered winding structure of seven or more layers of the sheath component wound around the core component. A method for producing the slub yarn includes a step of overfeeding a sheath component to a core component in the direction substantially perpendicular to a passage of the core component in a twisting zone of a false-twist texturing machine while the sheath component is guided by a guide repeatedly traversed along a passage of the core component, a distance between the guide and the passage of the core component being kept in a range not shorter than 10 cm. An apparatus for randomly traversing the sheath component along the core component during the false-twist texturing process is also provided.

7 Claims, 14 Drawing Figures

1
2
108
OSCILLATING DIRECTION
YARN RUNNING DIRECTION

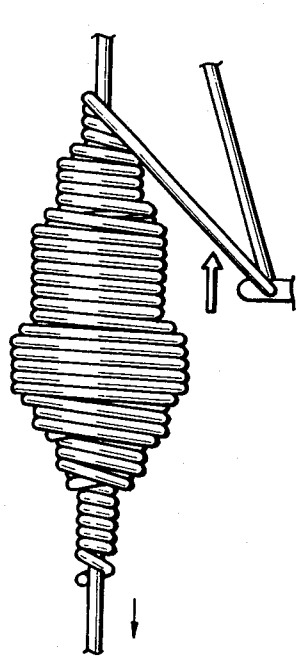
Fig. 2 (7)
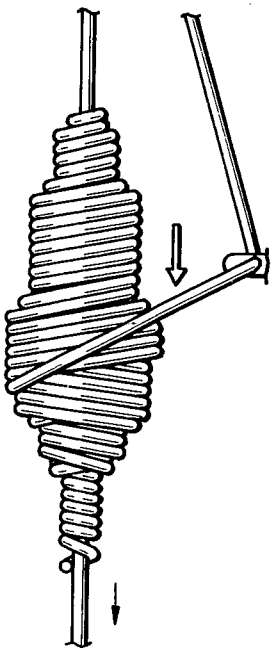
Fig. 2 (6)
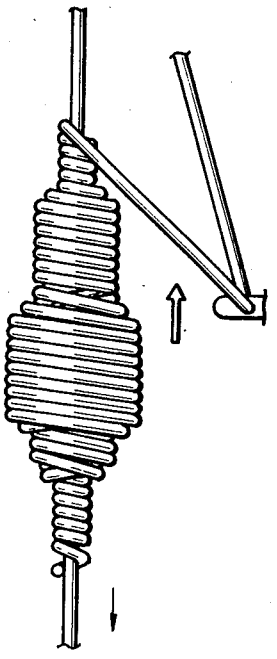
Fig. 2 (5)

METHOD AND APPARATUS FOR PRODUCING SLUB YARN

BACKGROUND OF THE INVENTION

1. Field of the Invention

The present invention relates to a slub yarn, in which a slub portion is formed by multiple windings of a sheath component around a core component, and a method and an apparatus for producing the same.

2. Description of the Related Art

Well known in the art are various slub yarns in which a slub portion is formed along a carrier portion (nonslub portion) by multiple windings of a sheath component around a core component by means of a false-twist texturing machine. For example, Japanese Examined Patent Publication (Kokoku) No. 55-22576 discloses a method for obtaining such slub yarn by feeding a sheath component to a core component in such a manner that the sheath component is positively traversed through a guide with a relatively longer period along the passage of the core component in a twisting zone of a false-twist texturing machine. The sheath component repeats a relatively shorter self-oscillation along the core component during the traverse motion. According to this method, since the sheath component is not fed at an overfeed rate sufficient to form a multilayered winding structure around the core component and the guide for the sheath component is maintained close to the core component, the resultant slub is relatively short and thin as well as of loose winding, though the shape thereof is of a typical fusiform. Regarding the apparatus proposed in this reference, since the yarn guide for the sheath component is driven by a power cylinder through a link mechanism, the traversing speed and distance thereof are limited to a lower level, so there are limited varieties of slub in the resultant yarn.

In Japanese Unexamined Patent Publication (Kokai) No. 58-109645, another slub yarn having a slub of a multiwinding structure is provided, in which an air-textured flat yarn is utilized as a sheath component and is fed to a core component in a manner similar to that of the abovesaid prior art method, except that the sheath component is sufficiently overfed but is not positively traversed along the core component. This method, however, has drawbacks in that the resultant slub has a deformed configuration because loops or fluffs inherent to the air-textured yarn protrude from a surface thereof. Moreover, a rigid slub having a multilayered winding structure of more than five layers cannot be easily obtained by this slub forming principle, as stated later.

SUMMARY OF THE INVENTION

Thus, it is a first object of the present invention to eliminate the abovesaid drawbacks of the prior art and provide a novel slub yarn having a rigid multilayered winding structure of more than seven layers.

It is a second object of the present invention to provide a novel method for producing the abovesaid slub yarn by utilizing a false-twist texturing machine.

It is a third object of the present invention to provide a novel apparatus for carrying out the abovesaid method.

For achieving the first object of the present invention, there is proposed a slub yarn, in which a sheath component is wound around a core component to form a plurality of slub portions along the axis of the yarn, whose structure is obtained by simultaneously false-twist texturing the core and sheath components, characterized in that the slub portion comprises a multilayered winding structure of seven or more layers of the sheath component wound around the core component.

The second object of the present invention is attainable by a method for producing a slub yarn by a false-twist texturing machine, comprising a step of overfeeding a sheath component to a core component in the direction substantially perpendicular to a passage of the core component in a twisting zone of the false-twist texturing machine; and texturing both the components by introducing them into a heater and a twister of the false-twist texturing machine, whereby a slub portion, in which the sheath component is wound around the core component with a plurality of windings, is formed along the lengthwise direction of the slub yarn, characterized in that the sheath component is guided by a guide repeatedly traversed along a passage of the core component, the distance between the guide and the passage of the core component being kept in a range not shorter than 10 cm.

The overfeeding rate of the sheath component relative to the core component is preferably within a range of from 20% to 80%.

The traversing distance of the guide is preferably not shorter than 5 cm.

The traversing distance of the guide may be varied in a random manner.

The third object is achievable by an apparatus for producing a slub yarn according to the present invention, comprising first and second means for feeding core and sheath components, respectively; a heater; a false-twister; and means for taking up the resultant yarn; each being arranged from upstream to downstream, whereby the two components are false-twisted together with each other to form a composite slub yarn having a slub portion therealong, a structure of the slub portion being such that the sheath component is wound around the core component to form a multilayered winding structure, characterized in that the apparatus further comprises a guide for guiding the sheath component to a passage of the core component in the twisting zone upstream from the heater, a distance between the guide and the passage of the core component being kept at a substantial length; means for traversing the guide along the passage of the core component; and means for controlling the motion of the means for traversing the guide.

The means for traversing the guide preferably comprises a motor electrically connected to the controlling means, a wheel secured on an output shaft of the motor, and a flexible belt engaged with a periphery of the wheel and holding the guide for the sheath component, whereby rotation of the motor is converted to a linear motion of the flexible belt.

The controlling means preferably comprises a random data generator for providing a random signal which, in turn, is output from the controlling means as a control signal to the motor, whereby the traversing distance of the guide is varied in a random manner.

BRIEF DESCRIPTION OF THE DRAWINGS

Other objects and advantages of the present invention will be more apparent with reference to the accompanied drawings illustrating the preferred embodiments of the present invention, wherein.

DESCRIPTION OF THE PREFERRED EMBODIMENTS

Figure 1:
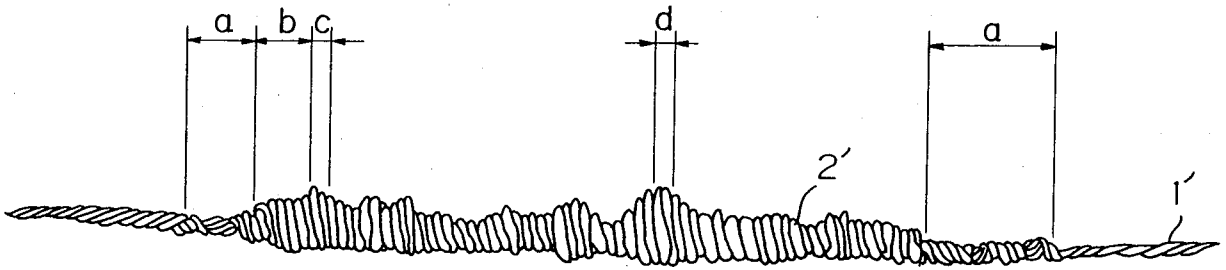
FIG. 1 illustrates a diagrammatic view of a typical slub yarn according to the present invention.

FIG. 1 illustrates an example of a slub yarn according to the present invention, in which a slub portion 2' has a multilayered structure of winding of a sheath component around a carrrer portion 1', which carrier portion is formed by a single twine of a core component and the sheath component. In FIG. 1, part a corresponds to a three-layered winding structure, b to a five-layered winding structure, c to a seven-layered winding structure, and d to a nine-layered winding structure, which structure will be explained in more detail later with respect to FIG. 2. According tó the present invention, there is a three-layered winding structure a at the opposite end regions of the slub portion and greater multilayered winding structures, including a seven or more layered winding structure c and/or d, in the middle region of the slub portion. In these multilayered winding structures, the sheath component is wound around the core component at a relatively small winding pitch. Since the thickness of the slub portion varies in the lengthwise direction in proportion to the number of winding layers, the shape of the slub portion is substantially a fusiform. In this connection, the winding angle of the layers becomes closer to a right angle as the layer number increases. In FIG. 1, the slub portion includes nine-, seven-, five-, and three-layered winding structures therein. However, other combinations of the winding structures in one slub portion may be possible, provided the substantial number of slub portions in one yarn include a multi-layered structure of at least seven windings, because a fabric made from sucn a slub yarn exhibits a unique, aesthetic appearance peculiar to the present invention.

The material usable as a core component is a multifilament which is usually utilized for false-twist texturing, such as polyester, polyamide, polypropylene, polyacrylic, or acetate. The material for the sheath component can also be selected from the above group. It need not be the same as the core component, i.e., may be different therefrom. If an undrawn polyester multifilament having a double refraction $\Delta n$ of more than 0.03 is utilized as the sheath component, the luster of the surface of the slub portion is decreased, whereby a fabric rich in color depth and elegant appearance is obtained. Alternatively, if a cation dyeable polyester multifilament is utilized as the sheath component, restrictions on the dyeing process for the yarn can be mitigated, whereby the core component to be combined with the sheath component can be more freely selected. Further, if a thick and thin type multifilament is utilized as the sheath component, surface irregularities of the slub portion are stressed more, which results in the aesthetic appearance of the resultant fabric.

Next, a method for producing the slub yarn of the above structure will be described in detail with reference to FIG. 3.

Figure 3:
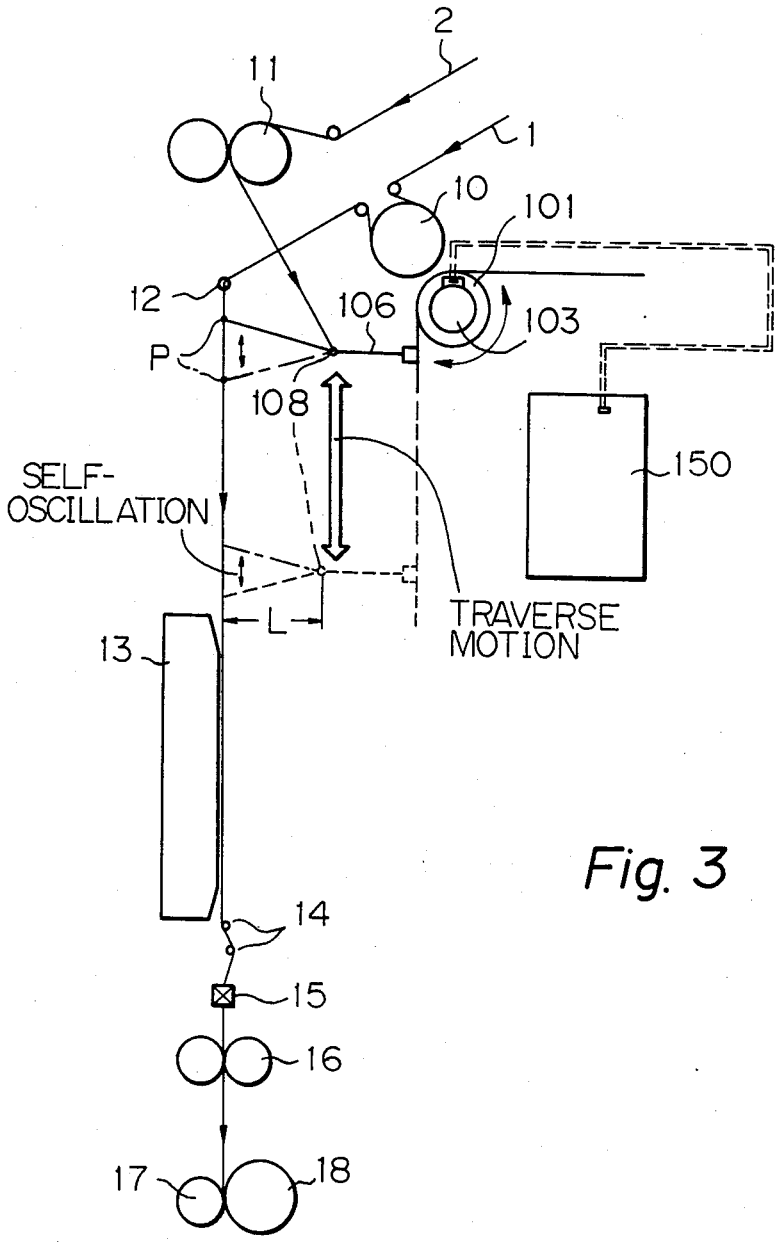
FIG. 3 is a diagrammatic side view of an apparatus for producing a slub yarn according to the present invention.

FIG. 3 diagramatically illustrates an apparatus utilized in the present invention. The apparatus is basically identical to a false-twist texturing machine, in which there are arranged in series, from upstream to downstream, a magnet tenser 10 for introducing a core component 1 into the process, a guide 12 for the core component 2, a heater 13 for heat setting a yarn to be treated, a twister 15 for imparting a twist to the yarn, a pair of delivery rollers 16 for withdrawing the yarn from the process, and a take-up roll 17 for winding the yarn to form a package 18. A pair of feed rollers 11 is provided, in parallel to the magnet tenser 10, for overfeeding the sheath component 2 into the process through a guide 108. The guide 108 is connected to a traversing unit described later and, thereby, is movable reciprocatedly along a yarn passage in the twisting zone.

According to the above apparatus, the core component 1 is fed at a constant tension defined by the magnet tensor 10 into the texturing process. The sheath component 2 is combined with the core component in the twisting zone defined between the guide 12 and the heater 13 through the guide 108, while being overfed by the feed rollers 11. When a downward traversing speed Vd of the guide 108 is close to the running speed Vy of the core component 1, the sheath component 2 is wound around a specific region of the core component 1 and forms the multilayered winding structure as described before. In this connection, it is important that a distance L between the passage of the core component 1 and the guide 108 be large enough to allow short-range self-oscillation along the passage of the core component 1 about the guide 108. According to this self-oscillation, a junction P of the two components 1 and 2 continually fluctuates, whereby the sheath component 2 is sequentially wound to overlap on the preceding windings. As the downward traverse of the sheath component 2 accompanying the running of the core component 1 lasts longer, the number of the winding layers increases and the slub portion having a winding structure of seven or more layers can be obtained. As the ratio Vd/Vy is closer to 1, the winding density of the sheath component 2 around the core component 1 becomes larger and the winding angle thereof is closer to a right angle.

Figure 7:
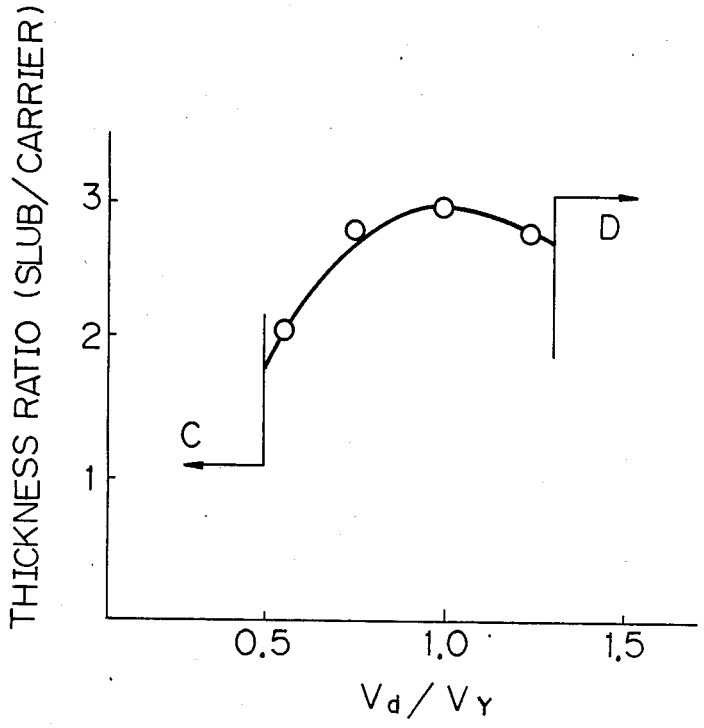
FIG. 7 is a graph of the relationship between a number of multilayers of winding of a sheath component around a core component and a ratio of a traversing speed of a sheath component in the same direction as that of feeding of a core component relative to a feeding speed of a core component.

The relationship between the ratio Vd/Vy and the maximum thickness of the slub portion is shown in FIG. 7. As apparent from the graph, the multilayered winding structure appears with a ratio Vd/Vy of more than 0.5. The maximum thickness slub portion is formed by a ratio of 1.0. However, if the ratio exceeds 1.3, the compactness of the slub structure is weakened. The slub portion obtained in accordance with a ratio within a range of from 0.5 to 1.3 has a fusiform, in which a three-layered winding structure occupies both end regions, and thicker winding structures in the middle region are fixedly held in place by dense windings of the end portion.

If the traverse of the guide 108 stops, the sheath component 2 is only made to self-oscillate in a short range along the yarn passage while being overfed to the core component 1 running at a speed Vy. This causes only a three-layered winding structure in the resultant yarn. Such a stop inherently occurs at a point where the traversing motion of the guide 108 begins to reverse. Therefore, a three-layered winding structure is always formed at the end of the slub portion.

During an upward (reverse) traversing motion of the guide 108, a carrier portion, that is, a portion where the slub is not formed and the core and sheath components are merely doubled while entangling with each other, is formed along the resultant yarn. Therefore, by controlling the duration of reverse traversing, the length of the carrier portion may be varied. Even in the case of the above stopping of the guide 108, the carrier portion may occur along with the three-layered winding structure if process conditions, such as the overfeeding rate of the sheath component or Vy, are properly selected.

Figure 8:
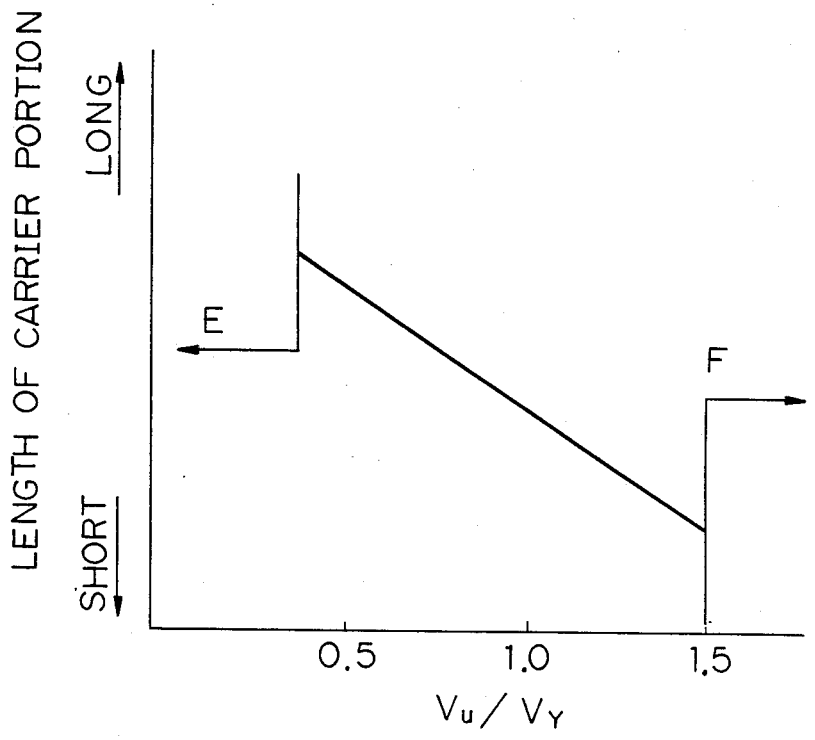
FIG. 8 is a graph of the relationship between a length of a carrier portion of a slub yarn and a ratio of a traversing speed of a sheath component in the reverse direction to that of feeding of a core component relative to a feeding speed of a core component.

FIG. 8 shows the relationship between a ratio of a reverse traversing speed Vu of the guide 108 to a running speed Vy of the core component (Vu/Vy) and a length of the carrier portion. From the graph, it may be seen that the ratio Vu/Vy is preferably less than 1.5 for forming the tight carrier portion. Otherwise, the sheath component tends to slacken during the process, which results in unstable processing. However, if lower than 0.3, the three-layered winding structure tends to generate among the carrier portions. Thus, the ratio Vu/Vy is preferably in a range of from 0.3 to 1.5. In FIGS. 7 and 8, C, D, E, and F represent undesirable areas.

As stated before, in the abovesaid formation of the slub portion, the self-oscillation of the sheath component about the guide 108 in a short range along the passage of the core component is necessary. The oscillation occurs naturally due to variance of tension of the sheath component winding around the core component. To achieve the proper oscillation, the distance between the guide 108 and the passage of the core component 1 must be 10 cm or more. If the distance is smaller than this value, the desirable multilayered winding structure cannot be formed. However, a wider distance is not preferable from the point of view of machine installation. Therefore, a distance in a range of from 10 cm to 30 cm is desirable.

As for the overfeed rate of the sheath component, a smaller rate results in a shorter self-oscillation range of the sheath component and vice versa. If the overfeed rate is smaller than 20%, a winding structure having more than seven layers cannot be formed. On the contrary, when exceeding 80%, the winding becomes unstable, whereby a uniform slub portion cannot be obtained.

By varying the traversing distance of the guide 108 in a random manner, various combination of shorter and longer slub portions in one yarn can be obtained.

The above result can be achieved by varying the transient time during which the ratio Vd/Vy reaches from 0 to a predetermined steady value at the startup period of every traverse motion.

In the apparatus, provision of antiballooning guides 14 between the heater 13 and the twister 15 is very useful for preventing vibration of the core component caused by the traverse motion of the guide 108, whereby the yarn tension before the twister 15 is kept stable.

Figure 2:
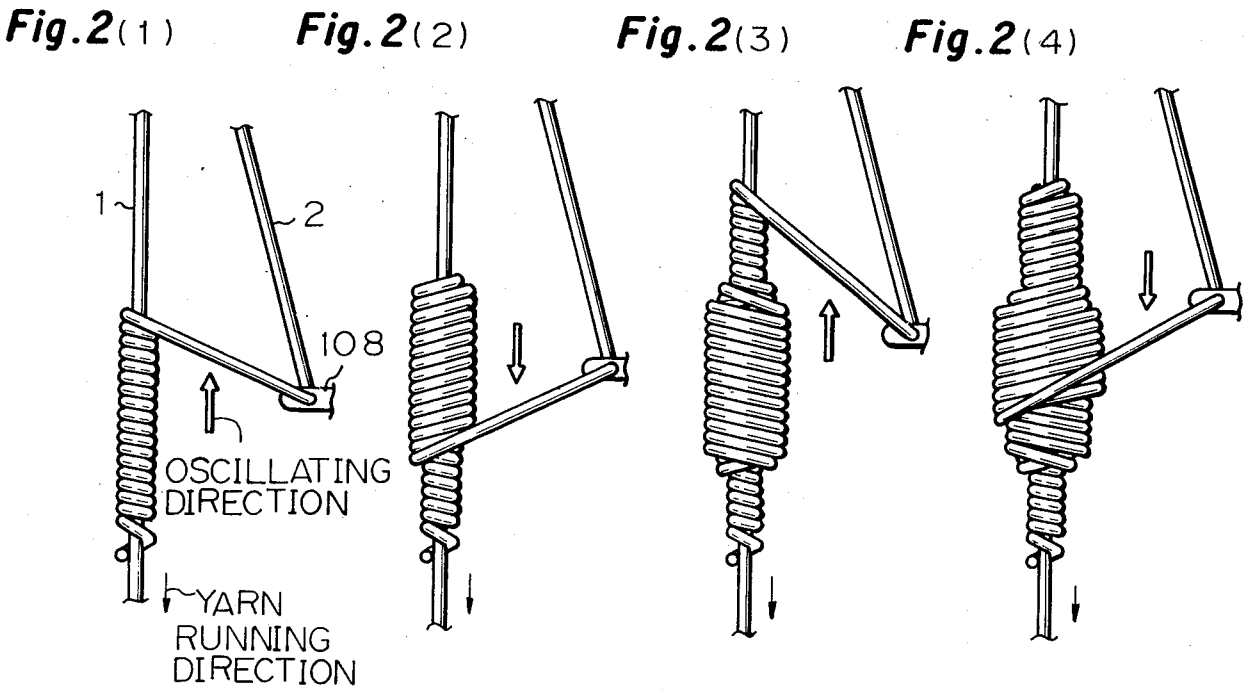
FIGS. 2 (1) through (7) are schematic views of steps of forming a slub portion according to the present invention.

The mechanism of formation of the slub portion will be explained by referring to FIGS. 2(1) through (7). The drawings illustrate sequential steps in which windings of the sheath component 2 during a certain downward traverse of the guide 108 are shown in a schematic manner. It should be noted that, in this example, the downward speed of the guide 108 is slightly slower relative to the running speed of the core component 1 and the sheath component 2 is made to self-oscillate in a short range along the core component 1 about the guide 108. In the first upward oscillation of the sheath component 2, a one-layered winding structure is formed around the core component 1, as shown in FIG. 2 (1). The following downward oscillation of the sheath component 2 forms a two-layered winding structure over the preceding one-layered winding structure, as shown in FIG. 2(2). According to the next upward oscillation shown in FIG. 2(3), a three-layered winding structure is constituted in the middle of the slub portion. It will be apparent that a fourth-, fifth-, sixth-, and seventh-layered winding structures are formed in a similar manner in the slub portion, as respectively illustrated in FIGS. 2(4), (5), (6), and (7).

Figure 4:
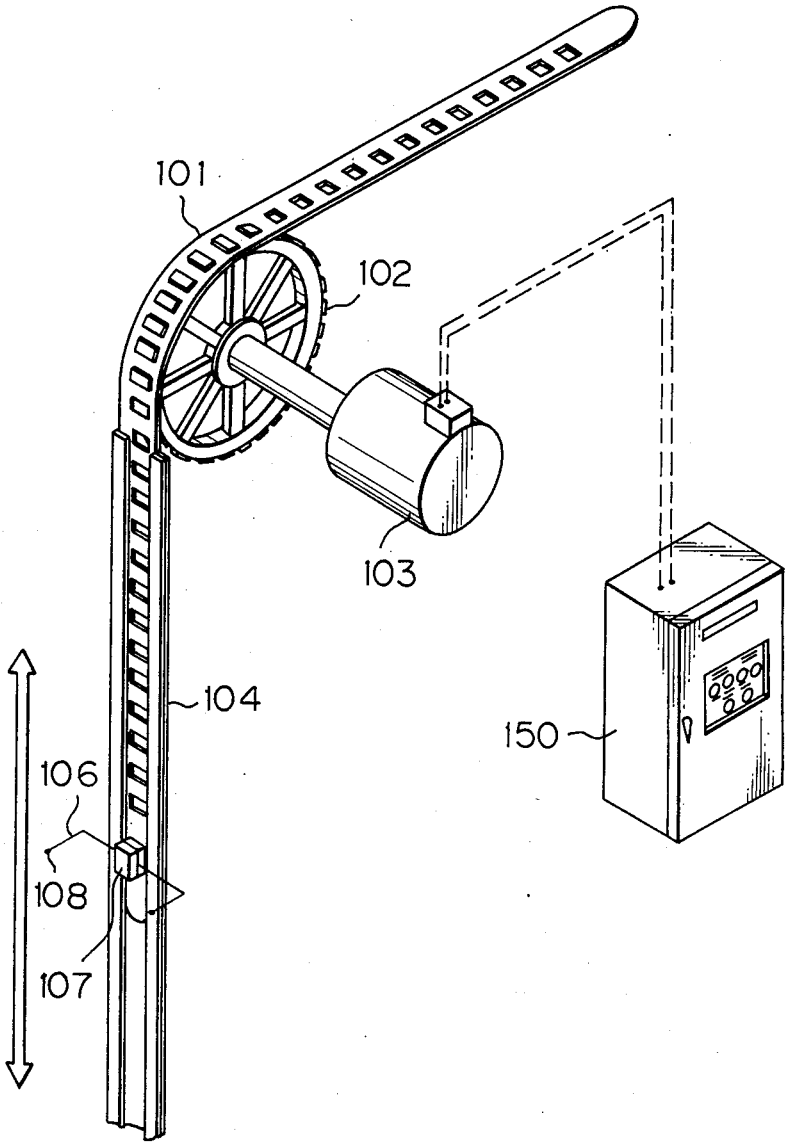
FIG. 4 is a perspective view of means for traversing a guide for a sheath component.

As stated above, it is very important according to the present invention to traverse the sheath component relative to the core component. To achieve such a traversing motion of the sheath component, a traversing unit shown in FIG. 4 is preferably utilized. In the drawing, the unit comprises a driving wheel 102 secured on an output shaft of a motor 103 and a flexible belt 101 intermeshingly engaged with a toothed periphery of the wheel 102 through a perforation provided along the length of the belt 101 so as to be driven by the wheel 102. The belt 101 is slidably guided along the two edges thereof by a rail 104 positioned in parallel to the passage of the core component 1 in the twisting zone of the false-twist texturing machine. At an end of the belt 101 guided by the rail 104, a guide 108 for traversing the sheath component 2 is secured through an arm 106 and a support 107. A controller 150 is electrically connected to the motor 103 for controlling the rotation thereof.

Figure 5:
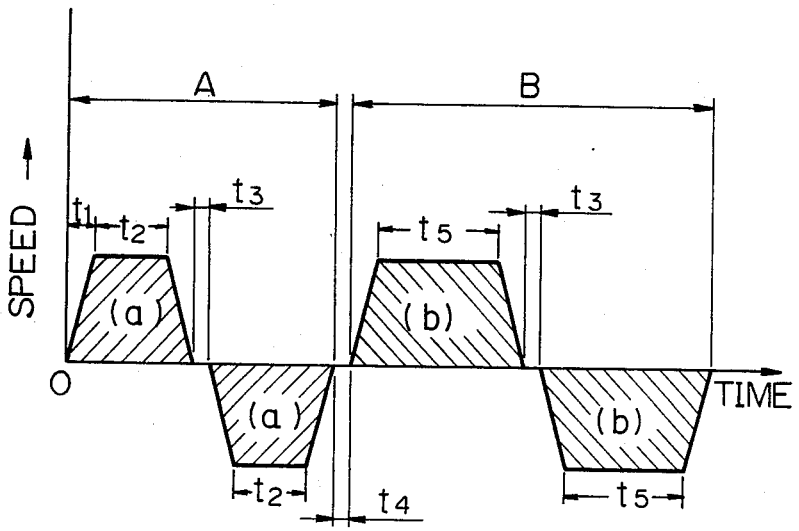
FIG. 5 illustrates an example of a time schedule of a traversing motion of a guide for a sheath component.
Figure 6:
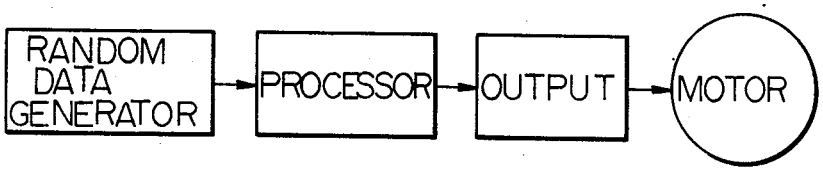
FIG. 6 is a block diagram of the control of a motor for traversing a guide for a sheath component.

FIG. 6 is a block diagram of the control of the motor 103, in which a signal output from a random data generator is input to a processor, converted therein to a control signal, and output therefrom to the motor 108. According to the control signal, the motor 108 is controlled to be in normal rotation, stop, or reverse rotation, whereby the belt 101 and, therefore, the guide 108 can be traversed with an arbitrary traversing distance and/or time schedule. One example of the control is shown in the graph of FIG. 5. The vertical axis of the graph represents the speed of the guide 108, in which an upper region corresponds to the downward traverse and a lower region to the upward traverse of the guide 108. The horizontal axis represents the time elapsed. When a control signal A is generated, the downward speed of the guide increases from 0 and reaches the maximum value after period t1. The speed is maintained at the maximum value in a period t2. Then it decreases to 0 and is maintained there in a period t3. Thereafter, the upward traverse of the guide 108 starts, in which the speed is maintained at the inverse maximum value in a period equal to t2, and again returns to 0. It should be noted that an area bounded by a curve of speed variation and the horizontal axis corresponds to a traversing distance. In this example, two areas positioned at opposite sides of the horizontal axis are equal to each other. Thus, the guide 108 returns to an initial position when the first traverse motion is completed. After a period t4, a next traverse motion starts according to another control signal B in a manner similar to the first one except that the period t5 for maintaining the maximum and inverse maximum speeds is different from t2 of the first one.

The above said control for one cycle of traverse motion or the guide is carried out corresponding to a respective signal from the random data generator, so traverse motion of different distances can be randomly repeated. Of course, the maximum distance is limited by the space between the guide 12 for the core component and the heater 13, which limitation has been already input in the controller 150.

The material suitable for the flexible belt 101 must have elasticity to be freely bent along the rail 104 as well as rigidity to be smoothly displaceable by a pushing and pulling force applied thereto. Additionally taking durability and specific strength into account, various fiber reinforced plastics are preferable. Particularly, carbon fiber reinforced plastic is most preferable because it has the further desirable property of self-lubrication. The shape of the belt 101 is not limited to a perforated tape but may be a toothed tape combined with a corresponding pulley in place of the toothed wheel 102. The other end of the belt 101 further from the guide 108 may be wound around the wheel 102, though it is free in FIG. 4.

The belt 101, the wheel 102, and other attachments of the belt driving system must be light in weight so that the moment of inertia thereof around the motor shaft becomes small and a sensitive response of the system and improved life thereof are obtained. The motor 103 must have a speed-torque characteristic allowing traversing of the guide at a high speed while overcoming the moment of inertia of the driving system as well as a capacity of repeated quick switching between the normal and reverse rotations for permitting such switching in a time shorter than the allowable interval between the adjacent half traverses. Such a motor may preferably be a pulse motor or a servo motor.

The abovesaid description will be more apparent from the following examples of the present invention.

EXAMPLE 1

For studying the optimum process conditions of the present invention, run Nos. 1 through 18 were carried out by means of the apparatus shown in FIG. 3 with polyester filament 150 d/72 f as a core component and polyester filament 75 d/48 f as a sheath component.

Process conditions common to every runs were as follows:

Running speed of core component Vy: 60 m/min
Rotational speed of twister: 108,000 rpm
Twist: 1800 t/m
Heater temperature: 200° C.
Tension of core component: 15 g Conditions peculiar to the respective runs are listed in Table 1.

TABLE 1

| | | Guide for sheath component | | | | | | |
|---|---|---|---|---|---|---|---|---|
| Run No. | Overfeed rate of sheath component % | Distance from core component cm | Traversing distance cm | Downward speed Vd m/min | Upward speed Vu m/min | Vd/Vy | Vu/Vy | *Remarks |
| 1 | 60 | 20 | 45 | 54 | 54 | 0.9 | 0.9 | O |
| 2 | 60 | 10 | 45 | 54 | 54 | 0.9 | 0.9 | O |
| 3 | 60 | 5 | 45 | 54 | 54 | 0.9 | 0.9 | X |
| 4 | 60 | 35 | 45 | 54 | 54 | 0.9 | 0.9 | O |
| 5 | 15 | 20 | 45 | 54 | 54 | 0.9 | 0.9 | X |
| 6 | 30 | 20 | 45 | 54 | 54 | 0.9 | 0.9 | O |
| 7 | 75 | 20 | 45 | 54 | 54 | 0.9 | 0.9 | O |
| 8 | 90 | 20 | 45 | 54 | 54 | 0.9 | 0.9 | X |
| 9 | 60 | 20 | 3 | 54 | 54 | 0.9 | 0.9 | X |
| 10 | 60 | 20 | random (5 to 90) | 54 | 54 | 0.9 | 0.9 | O |
| 11 | 60 | 20 | 45 | 18 | 54 | 0.3 | 0.9 | X |
| 12 | 60 | 20 | 45 | 36 | 54 | 0.6 | 0.9 | O |
| 13 | 60 | 20 | 45 | 84 | 54 | 1.4 | 0.9 | O |
| 14 | 60 | 20 | 45 | 102 | 54 | 1.7 | 0.9 | X |
| 15 | 60 | 20 | 45 | 54 | 12 | 0.9 | 0.2 | X |
| 16 | 60 | 20 | 45 | 54 | 30 | 0.9 | 0.5 | O |
| 17 | 60 | 20 | 45 | 54 | 84 | 0.9 | 1.4 | O |
| 18 | 60 | 20 | 45 | 54 | 96 | 0.9 | 1.6 | X |

Note:
*Mark O means within scope of present invention.
Mark X means out of scope of present invention.

In run No. 1, a slub yarn having a slub portion including a multi winding structure of seven or more layers was stably produced. In run No. 2, the layer number of the slub portion was larger than that of run No. 1 and the appearance of the yarn was unique due to this thicker slub portion. In run No. 3, the sheath component could not be completely wound around the core component during the process and was apt to slacken between the feed rollers and the guide for the sheath component, whereby the process was very unstable. In run No. 4, the slub shape was rather flat compared to run No. 1. Therefore, the preferable distance between the core component and the guide was more than 10 cm.

In run No. 5, the winding of the sheath component became insufficient due to the low overfeed rate thereof, which resulted in a loose slub and the trouble in the later process. In run No. 6, the range of the self-oscillation was somewhat shorter than that of run No. 1, whereby the pitch of the irregularity within one slub portion became smaller. In run No. 7, the pitch of the irregularity within the slub was rather larger than that of run No. 1 and the tightness thereof was more improved. In run No. 8, there was a tendency similar to that of run No. 3 due to the excessive overfeed rate of the sheath component. Therefore, the preferable overfeed rate of the sheath component was within a range from 20% to 80%.

In run No. 9, since the traversing distance of the guide was too short, almost no winding structure of seven or more layers was formed in the slub portion. On the other hand, in run No. 10, a yarn having a plurality of slub portions of various lengths and thicknesses and unique appearances were produced according to the random traversing of the sheath component.

In run No. 11, the ratio of Vd/Vy was too small to obtain the slub portion peculiar to the yarn according to the present invention. In runs Nos. 12 and 13, a yarn similar to that of run No. 1 and within the scope of the present invention was obtained. Contrary to this, the desired yarn was not produced by run No. 14 due to an excessively large ratio of Vd/Vy. Therefore, the ratio of Vd/Vy is preferably in a range of from 0.7 to 1.5.

In run No. 15, the resultant yarn was not the desired one because the quicker reverse traverse of the guide gave a too long carrier portion of the yarn. In run Nos. 16 and 17, the yarn according to the present invention was stably obtained though the interval between the slub portions along the yarn was larger in the case of run No. 16 relative to the case of run No. 17. On the other hand, in run No. 18, the process was very unstable because of an excessively larger ratio of Vu/Vy.

EXAMPLE 2

For studying the effect of undrawn filaments on the slub yarn, run No. 19 was carried out under conditions similar to run No. 1 with a highly oriented undrawn polyester filament 150 d/48 f having a double refraction $\Delta n=0.0812$ and the same kind of filament 115 d/36 f having a double refraction $\Delta n=0.0454$ as core and sheath components, respectively. The process conditions were, however, weakened as follows so as to match with the undrawn filament:

Rotational speed of twister: 72,000 rpm
Twist: 1200 t/m
Heater temperatuer: 200° C.
Tension of core component: 20 g The resultant yarn had a configuration similar to that of run No. 1. A fabric obtained therefrom exhibited an elegant appearance due to its deeper color shade after dyeing.

EXAMPLE 3

Run 20 was carried out under identical process conditions as run No. 1 except that a cation dyeable polyester filament 75 d/24 f was used as the sheath component. The resultant yarn was treated with cationic dye and disperse dye, whereby the carrier portion of the yarn exhibited a mixed color caused by the two dyes and the slub portion exhibited a color caused by the cationic dye.

EXAMPLE 4

By using the slub yarn obtained from run No. 1 as a warp and a weft, a mat weave fabric was produced with a warp density of 35 end/inch and a weft density of 77 end/inch. The fabric was dyed in the conventional manner and, thereafter, press-finished under condition of 120° C. and 20 kg/cm$^2$. Due to this press finishing, the slub portion of the yarn was flattened and widened in width, whereby the thickness difference between the slub and carrier portions was further developed. Moreover, the luster of the slub portion was exhaused.

In the above-stated examples, though a polyester filament was used as the core and sheath components, other materials such as polyamide, acetate, or polyacrylic may be utilized as both or one of the components. In those cases, the rotational speed of the twister, twist, heater temperature, and tension of the core component should be varied in accordance with the thermal and mechanical properties of the material utilized.

As stated above, the slub yarn according to the present invention has a fusiformed slub portion in which a plurality of thicker and thinner regions are mixed, which provides a unique effect on the appearance thereof. Further, since the sheath component is tightly wound around the preceding winding layers, the shape of the slub can be rigidly maintained even if rubbed during the post-treatment. Such a slub portion can be obtained by a method according to the present invention, by which a multilayered winding structure never obtained by the prior art is stably and economically produced. By combining different types of core and sheath components, various special effects can be achieved. For example, if highly oriented undrawn polyester filament having a double refraction $\Delta n$ of more than 0.03 is used as the sheath component, the dye absorbing capacity of the slub portion is considerably increased, whereby the color effect of the yarn can be elevated due to the deeper color of the yarn surface as well as the unique slub shape. Alternatively, if a cation dyeable polyester filament is used as the sheath component, the slub portion and the carrier portion can exhibit different colors from each other after dyeing. Further, if a thick-and-thin type multifilament is used as the sheath component, since the molecular orientations of the thick portion and thin portion differ from each other, the color depth within one slub can be varied from place to place after dyeing.

According to the apparatus of the present invention, the above method can be carried out without any trouble. Particularly, since the traversing schedule of the guide for the sheath component can be controlled in a random manner, various slub yarns can be produced in accordance with need.

We claim:

1. A method for producing a slub yarn by a false-twist texturing machine, comprising a step of overfeeding a sheath component to a core component in the direction substantially perpendicular to a passage of the core component in a twisting zone of a false-twist texturing machine, whereby a slub portion, in which the sheath component is wound around the core component with a plurality of windings, is formed along the lengthwise direction of the slub yarn, wherein said sheath component is guided by a guide repeatedly traversed along a passage of the core component, a distance between the guide and the passage of the core component being kept in a range sufficient for said sheath component to self oscillate during each said traversal of said guide, said range being at least 10 cm.

2. A method defined by claim 1, characterized in that an overfeeding rate of the sheath component relative to the core component is within a range of from 20% to 80%.

3. A method defined by claim 1, characterized in that a traversing distance of the guide is not shorter than 5 cm.

4. A method defined by claim 1, characterized in that a traversing distance of said guide is varied in a random manner.

5. An apparatus for producing a slub yarn, comprising first and second means for feeding core and sheath components, respectively; a heater; a twister; and means for taking up the resultant yarn; each being arranged in series from upstream to downstream, whereby the two components are false-twisted together with each other to form a composite slub yarn having a slub portion therealong, a structure of the slub portion being such that the sheath component is wound around the core component to form a multilayered winding structure, wherein said apparatus further comprises a guide for guiding the sheath component to a passage of the core component in the twisting zone upstream from the heater, a distance between the guide and the passage of the core component being kept at a substantial length; means for traversing the guide along the passage of the core component; and means for controlling the motion of the means for traversing the guide, wherein said subtantial length is in a range sufficient for said sheath component to self oscillate during each said traversal of said guide, said range being at least 10 cm.

6. An apparatus defined by claim 5, characterized in that the means for traversing the guide comprises a motor electrically connected to the controlling means, a wheel secured on a output shaft of the motor, and a flexible belt engaged with a periphery of the wheel and holding the guide for the sheath component, whereby rotation of the motor is converted to a linear motion of the flexible belt.

7. An apparatus defined by claim 5, characterized in that the controlling means comprises a random data generator for providing a random signal which, in turn, in output from the controlling means as a control signal to the motor, whereby the traversing distance of the guide is varied in a random manner.

* * * * *